United States Patent [19]

Schiel et al.

[11] 3,950,862

[45] Apr. 20, 1976

[54] SOLAR CELL DETECTOR ARRAY FOR ENGAGEMENT SIMULATION

[75] Inventors: Ernst J. Schiel; Rudolph R. Gammarino, both of Ocean, N.J.

[73] Assignee: The United States of America as represented by the Secretary of the Army, Washington, D.C.

[22] Filed: Oct. 3, 1974

[21] Appl. No.: 511,857

[52] U.S. Cl. ..... 35/25

[51] Int. Cl.[2] ..... F41C 27/00

[58] Field of Search ..... 35/25; 273/101.1; 340/213; 250/212, 551; 331/94.5

[56] References Cited

UNITED STATES PATENTS

| | | | |
|---|---|---|---|
| 3,434,226 | 3/1969 | Schaller | 35/25 |
| 3,452,453 | 7/1969 | Ohlund | 35/25 |
| 3,466,761 | 9/1969 | Stinchcomb | 35/25 |
| 3,633,285 | 1/1972 | Sensney | 35/25 |
| 3,700,336 | 10/1972 | Clegg | 250/212 X |

OTHER PUBLICATIONS

"The Way Things Work"–Encyclopedia, Published by Simon & Schuster, pp. 92–95.

*Primary Examiner*—Louis G. Mancene
*Assistant Examiner*—John H. Wolff
*Attorney, Agent, or Firm*—Nathan Edelberg; Robert P. Gibson; Jeremiah G. Murray

[57] ABSTRACT

This invention relates to a multi-solar cell detection arrangement for detection of pulsed laser radiation inside a military helmet. Each solar cell is coupled to a ferrite core which allows operation in full sunlight without the need of optical filters. The solar cells are activated by short-pulsed laser radiation, directed from a laser transmitter such as an injection laser transmitter mounted on an M-16 rifle and bore-sighted with a rifle sight so as to simulate rifle fire.

3 Claims, 2 Drawing Figures

SOLAR CELL DETECTOR ARRAY FOR ENGAGEMENT SIMULATION

The invention described herein may be manufactured, used, and licensed by or for the Government for governmental purposes without the payment to us of any royalties thereon.

BACKGROUND OF THE INVENTION

A. Field of the Invention

The present invention relates to a monitoring device to aid in training military personnel in the use of present and future weapon systems.

B. Prior Art

In man-to-man engagement simulation, it is desirable to score each individual's performance in a tactical environment. Previously a referee scored the individual's performance and determined when personnel were removed from the tactical exercises. This method of scorekeeping was inaccurate and often times subjective. To overcome this difficulty, the present invention provides a man-to-man engagement simulator which allows for impartial accurate scorekeeping during military field exercises.

SUMMARY OF THE INVENTION

A solar cell detector array responsive to a short-pulsed laser beam for engagement simulation comprises a closed loop ferrite core with a plurality of primary coils uniformly wound and spaced around a portion of the ferrite core. Included are a plurality of silicon solar cells, each in circuit with a respective primary coil, and an output coil or secondary winding around the remaining portion of the ferrite core. The ratio of the primary windings to the output secondary winding is in the ratio of typically one to four. The primary winding provides a dc short circuit to the solar cells. Charge build-up, due to current generated by background photon flux is thereby inhibited. Furthermore, the solar cell array coupled through a ferrite core provides a matched impedance to a high speed amplifier. Included further are means responsive to the output of the secondary winding to trigger an alarm indicator. Also included is a deactivator or RF transmitter circuit responsive to the alarm indicator signal. The complete solar cell detector array can be located inside a head covering helmet or distributed on the body or mounted on a vehicle and registers a hit by a short laser pulse.

DESCRIPTION OF THE PREFERRED EMBODIMENT

For a better understanding of the invention, the following description is taken in connection with the accompanying drawings.

Figure 1:
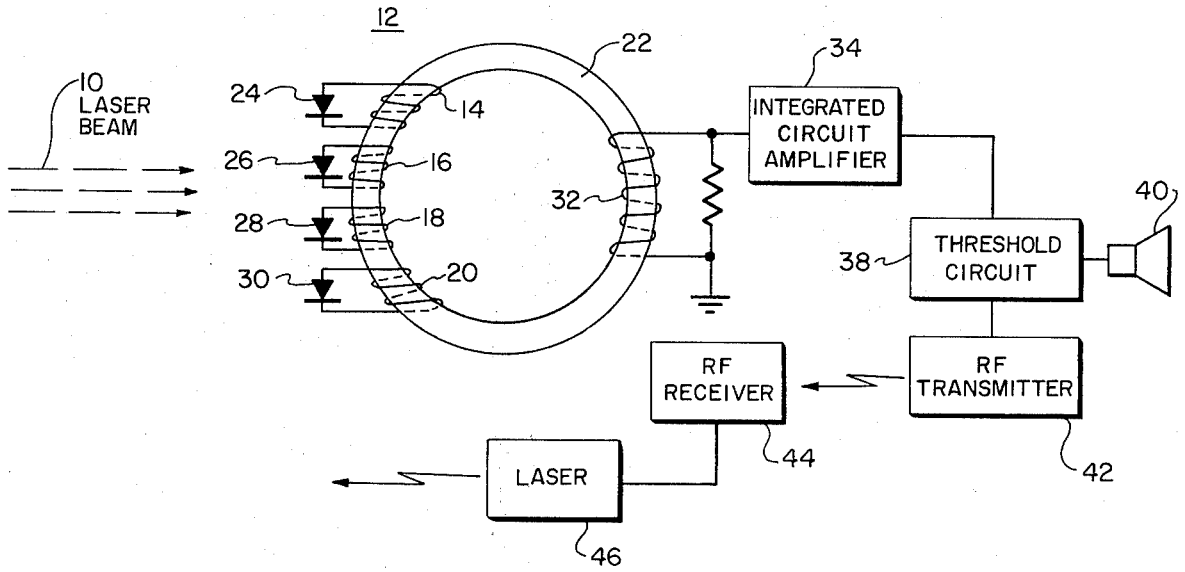
FIG. 1 is a block schematic diagram of the optical detector array.
Figure 2:
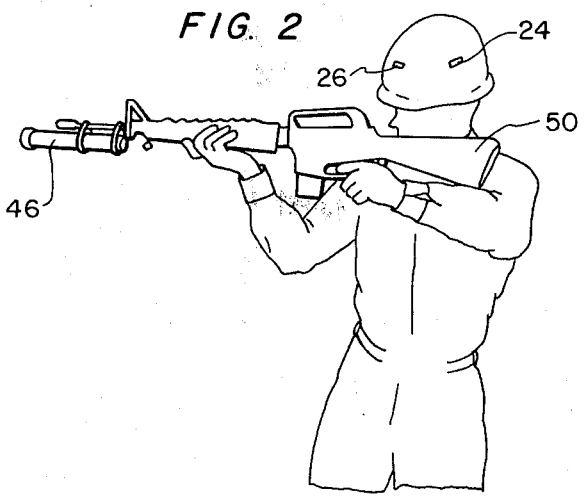
FIG. 2 shows the tactical operation of the engagement simulator.

Referring to FIG. 1, there is shown at 10 a commercially available pulsed injection laser signal source to provide a collimated beam of light to activate the solar cell detector array 12. A plurality of coils 14, 16, 18 and 20 are wound around a first portion of the ferrite core 22. Each coil is connected across respective solar cells 24, 26, 28 and 30 and are inductively coupled through a common magnetic flux path afforded by the ferrite core 22 to a common load or secondary winding 32 which is wound around another or portion of the ferrite core 22 to provide an output signal. The primary coils 14, 16, 18 and 20 together with the secondary coil 32, form the windings of a conventional RF transformer. The primary coils 14, 16, 18 and 20 provide a dc short circuit to the silicon solar cells 24, 26, 28 and 30 so that when sunlight or background radiation impinges on the solar cells there is no corresponding output at the secondary. When short light pulses generated by the aimed injection laser 10 impinge on the solar cells 24, 26, 28 and 30 a current pulse is generated. This current pulse flows through the coils 14, 16, 18 and 20 creating magnetic flux pulses around the ferrite core 22. These flux pulses add linearly and are coupled to the secondary winding 32 to produce a signal which is amplified in circuit 34. The amplifier circuit 34 operates over a wide dynamic range to preclude saturation and provides an output signal adapted to activate a threshold or gating circuit 38. The output signal derived from the threshold circuit 38 activates an alarm 40 indicating the target hit. Simultaneously, the threshold circuit 38 also activates a radio frequency transmitter circuit 42 which transmits an RF signal to an RF receiver 44, which in turn provides a detected signal for switching off the laser rifle 50 so that it cannot be fired. In the drawings, with particular reference to FIG. 2, the optical detector array 14 through 42 are mounted in a head covering helmet 48. The array, however, is not limited to this single position. Detectors 24 and 26 are visible in this front view. Detectors 28 and 30 are situated on the opposite side of the helmet 48. The RF receiver 44 is located in a laser package 46 and attached to the M-16 rifle 50 in the same manner as a bayonet. The total weight of the M-16 rifle with laser attached is the same as a bayonet and M-16 rifle. A device for counting and registering the number of rifle shots to simulate an ammunition magazine may be installed in the M-16 rifle 50. Because the distance between detectors on the helmet may be several inches, the laser beam diameter must be large enough to cover the spacing between the detectors to eliminate false signals created by other short light pulses than the laser source. The laser can be programmed to send coded signals and detector plus a signal processing circuit to respond only to such coded signals.

What is claimed is:

1. A solar cell detection system for simulated fire arm engagement between combatants comprising:

a radiation source means for emitting light pulses in selected directions under the control of one of said combatants;

at least one solar cell, said cell being activated by impingement of said radiation source means;

a transformer having a ferrite core, at least one primary winding and a secondary winding coupled to said core;

each said solar cell connected directly across said primary winding;

means connected across the output of said secondary winding for damping oscillations in said secondary winding;

an alarm means for producing an output signal when activated; and a threshold circuit means coupled to the output of said secondary winding and said alarm means for activating said alarm means upon receipt of a signal having a predetermined value from said secondary winding.

2. A system for simulating fire arm engagement as defined in claim 1, further comprising:

a plurality of said primary windings each said primary winding coupled to said core in additive relationship; and a plurality of said solar cells each connected directly across a different one of each said primary windings.

3. A system for simulating fire arm engagement as defined in claim 2, and wherein said radiation source means includes:

a pulsed laser transmitter means;

an rf receiver means connected to said laser transmitter means for deactivating said laser transmitter means upon reception of a predetermined signal; and an rf transmitter means connected to said threshold circuit means for transmitting said predetermined signal to said rf receiver means upon activation of said rf transmitter means by said threshold circuit means.

* * * * *